US007073432B2

(12) United States Patent
Marttila et al.

(10) Patent No.: US 7,073,432 B2
(45) Date of Patent: Jul. 11, 2006

(54) BINDING DEVICE AND A METHOD FOR FORMING A STOCK OF BRUSHWOOD

(75) Inventors: Mauri Marttila, Valkkinen (FI); Harri Niemi, Tampere (FI); Kari Pärssinen, Tampere (FI)

(73) Assignee: Plustech Oy, Tampere (FI)

( * ) Notice: Subject to any disclaimer, the term of this patent is extended or adjusted under 35 U.S.C. 154(b) by 13 days.

(21) Appl. No.: 10/489,997

(22) PCT Filed: Sep. 20, 2002

(86) PCT No.: PCT/FI02/00752

§ 371 (c)(1),
(2), (4) Date: Mar. 18, 2004

(87) PCT Pub. No.: WO03/023440

PCT Pub. Date: Apr. 10, 2003

(65) Prior Publication Data

US 2004/0255796 A1 Dec. 23, 2004

(30) Foreign Application Priority Data

Sep. 21, 2001 (FI) ..... 20011857

(51) Int. Cl.
*B65B 13/22* (2006.01)

(52) U.S. Cl. ..... 100/32; 100/2; 100/7; 100/13; 100/26; 100/29

(58) Field of Classification Search ..... 100/2, 100/3, 7, 8, 12, 13, 25, 26, 27, 29, 30, 32, 100/33 R, 17, 20; 53/399, 589
See application file for complete search history.

(56) References Cited

U.S. PATENT DOCUMENTS 3,120,171 A * 2/1964 Hall et al. ..... 100/26

(Continued)

FOREIGN PATENT DOCUMENTS

DE 3226060 A1 1/1984

(Continued)

OTHER PUBLICATIONS

International Search Report, Form PCT/ISA/210, as issued by Swedish Patent Office in Connection with PCT Application No. PCT/FI02/00752.

(Continued)

*Primary Examiner*—Derris H. Banks
*Assistant Examiner*—Jimmy Nguyen
(74) *Attorney, Agent, or Firm*—Quarles & Brady LLP

(57) ABSTRACT

A method for binding logging waste or small timber material by using an automatic binding device, wherein the material is collected in a continuous bundle of brushwood and fed in the longitudinal direction. The material of the bundle of brushwood is compressed further in the binding device by tensioning the band which is fed in a continuous manner around the bundle of brushwood, and the band is finally locked as a strap which keeps the bundle of brushwood together. The binding device comprises at least binding means which are arranged for feeding a continuous band around the material to be bound, for compressing the material by tensioning the band and for forming a locked strap by means of the band around the material, and a transfer mechanism which is arranged to allow the movement of the binding means from an initial position towards the material when the band is tensioned, to allow the movement of the binding means in the direction of the surface of the material when the material is simultaneously compressed by tensioning the band further, and during the compression to allow the orientation of the position of the binding means continuously towards the material at different locations of its surface, as well as to return the binding means to the initial position after the formation of the strap.

19 Claims, 6 Drawing Sheets

U.S. PATENT DOCUMENTS

| | | | | |
|---|---|---|---|---|
| 3,804,001 | A | 4/1974 | Lingerich et al. | 100/4 |
| 3,898,924 | A | 8/1975 | Mead et al. | 100/12 |
| 4,254,703 | A * | 3/1981 | Fulton et al. | 100/2 |
| 4,399,745 | A | 8/1983 | Jorgensen et al. | 100/2 |
| 5,377,479 | A | 1/1995 | Wilstrand et al. | 56/14.3 |
| 5,467,701 | A | 11/1995 | Bartzick et al. | 100/4 |

FOREIGN PATENT DOCUMENTS

| | | | |
|---|---|---|---|
| EP | 1121851 | A2 | 8/2001 |
| FI | 97015 | B | 6/1996 |
| SE | 458355 | B | 3/1989 |
| SE | 511379 | C2 | 9/1999 |

OTHER PUBLICATIONS

International Preliminary Examination Report, Form PCT/IPEA/409, as issued by the Swedish Patent Office in Connection with PCT Application No. PCT/FI02/00752.

* cited by examiner

BINDING DEVICE AND A METHOD FOR FORMING A STOCK OF BRUSHWOOD

CROSS-REFERENCE TO RELATED APPLICATIONS

This application claims priority of PCT Patent Application PCT/FI02/00752, filed 20 Sep. 2002, which claims priority of Finnish Patent Application Number 20011857, filed 21 Sep. 2001.

FIELD OF THE INVENTION

The invention relates to a binding device for binding logging waste or small timber material to a cylindrical stock of brushwood. The invention relates to a method for binding logging waste or small timber material to a cylindrical stock of brushwood.

BACKGROUND OF THE INVENTION

In connection with harvesting, a lot of logging waste which is suitable for use as a fuel is developed in the forest, wherein the logging waste is normally crushed to chips and combusted in furnaces. The logging waste consists of branches which come off in connection with the delimbing of tree stems, when the tree stem is manipulated, for example, at the harvester head of a forest working machine. The same device is also used to cut the top of the tree stem which is left as logging waste. The logging waste may also consist of other small and thin trees or brushwood.

The logging waste can be compressed by means of various devices to a compact bundle with a circular cross-section and a varying length, wherein it is referred to as a so-called stock of brushwood, which thus consists of compressed and bound branches and tops. One such device is presented in Swedish patent publication 511379, wherein the device consists of a compressing element of two parts. Material is fed into the first compressing chamber and compressed into the next compressing chamber. In the second compressing chamber, the material is compressed further, and simultaneously a cord or a wire is wound around it so that it would remain in the compressed state. The latter compressing chamber grips the formed bundle and pulls it forward, after which the compressing chamber returns to its initial position to continue the compressing and the binding. The bundle is cut to a desired length by a cutting apparatus. The bundling device is mounted on the frame of a forest working machine where also a boom assembly and a loader are placed for manipulating the logging waste and the bundles.

Another known device is presented in the Swedish publication 458355 and in the corresponding Finnish publication 59904.

In the known devices, several revolutions of a cord are wound around the bundle, but the cord is left unlocked, when the binding device moves to a new binding point. The cord is cut in connection with sawing of the bundle, but the end of the cord is not fixed. In one bundle, there are about 5 binding points and 2 to 4 revolutions of the cord. For binding the ends of the bundle, several revolutions of the cord are used.

It has also been found in practice that the cords are loosened during the handling of the bundles and also at the stage when the bound bundle is no longer subjected to compression by the chambers. Because of the high compressibility of logging waste, the material must be compressed by an auxiliary chamber or auxiliary means to achieve successful binding. When the compression ceases, the material tends to return and exerts a force effect on the cords. As a result of the loosening of the cords, the bundle may open up and the necessary volume may increase, which is not economical in view of transportation and energy consumption. The bundles are difficult to process further if they are not held together by the cords. The cords may also be broken as a result of, for example, rotting or a strong force effect. Impregnated cords are expensive to use and may be hazardous waste. The quantity of cord used in one bundle is about 30 to 40 m.

SUMMARY OF THE INVENTION

It is an aim of the present invention particularly to eliminate the above-mentioned problems related to the loosening of the bundle and its binding with a cord. Furthermore, logging waste must be brought into a compact bundle, which will involve intensive force effects and large play which, in turn, will cause loadings and problems in the construction and operation of the device.

By means of the device according to the invention, a means used in the binding can be tensioned and locked around the bundle to prevent enlargening of the bundle and to achieve a bundle which is as compact as possible. This means is also used for compressing by tightening, wherein it is possible to eliminate extra compression chambers or means. The compression is not possible with cord winding devices of prior art. Thanks to the locking, the bundle is also held together better during the handling. When a metal wire is used as the binding means, the bundle becomes strong and resistant to handling. Thanks to the more efficient compression, the number of binding points can be reduced and the costs are lower than for an impregnated cord.

A metal strap can be easily removed in one piece before the bundle is broken up and chipped, wherein the strap is cut and removed. In the case that the strap is crushed as well, the metal can be easily separated from the chips in different processing steps, for example by magnetic graders.

Some known automatic band binding devices are presented in U.S. Pat. No. 3,804,001 and U.S. Pat. No. 5,467,701, in which the band forming the strap is supplied from a coil, the end of the band is guided around the piece to be wound, for example by means of a chute, and the end of the band is fixed to the band, for example by punching, and it is cut, to form a strap.

However, the binding devices of prior art are not suitable as such for binding logging waste, because the compressibility of the material varies to a large extent. For this reason, for example the strap feeding chute must be placed farther away from the compressed material, wherein the binding and the tightening becomes more difficult and the winding becomes loose. Because of the compression, the frictional forces between the band and the material are great, but the formation of a loose bundle must still be prevented. At the same time, the loadings of the band and the means for feeding the band must be kept low to prevent breaking of the band and the damaging or blocking of the means.

The mechanism according to the invention is used to move the means of the binding device, which feed, tighten and lock the band, towards the material to be bound in such a way that they allow long movements of transfer in the compact form. At the same time, the binding means can always be placed in the same angular position in relation to the material, for example tangentially, wherein the binding means and the band remain in a position which does not cause extra loadings or slackening of the band. The position is preferably floating, wherein the binding means automatically turn in a swinging way towards the material, wherein the cutting loadings of the band are reduced, the loading of the mechanism is reduced, and also the need for active control and actuators is reduced. The device is particularly suitable for a cylindrical bundle of brushwood.

According to one embodiment of the invention, a particularly durable and compact structure is achieved when the necessary mechanisms are doubled and placed on different sides of the guide means. The mechanism is thus less subjected to torsion or deflections, and the resulting structure is as narrow as possible. It is possible to utilize identical parts in the different mechanisms. Using the mechanism, for example the use of slides, which are easily soiled, is avoided.

BRIEF DESCRIPTION OF THE DRAWINGS

In the following, the invention will be described in more detail by using, as an example, an advantageous embodiment of the invention with reference to the appended drawings, in which.

DETAILED DESCRIPTION OF THE INVENTION

Figure 1:
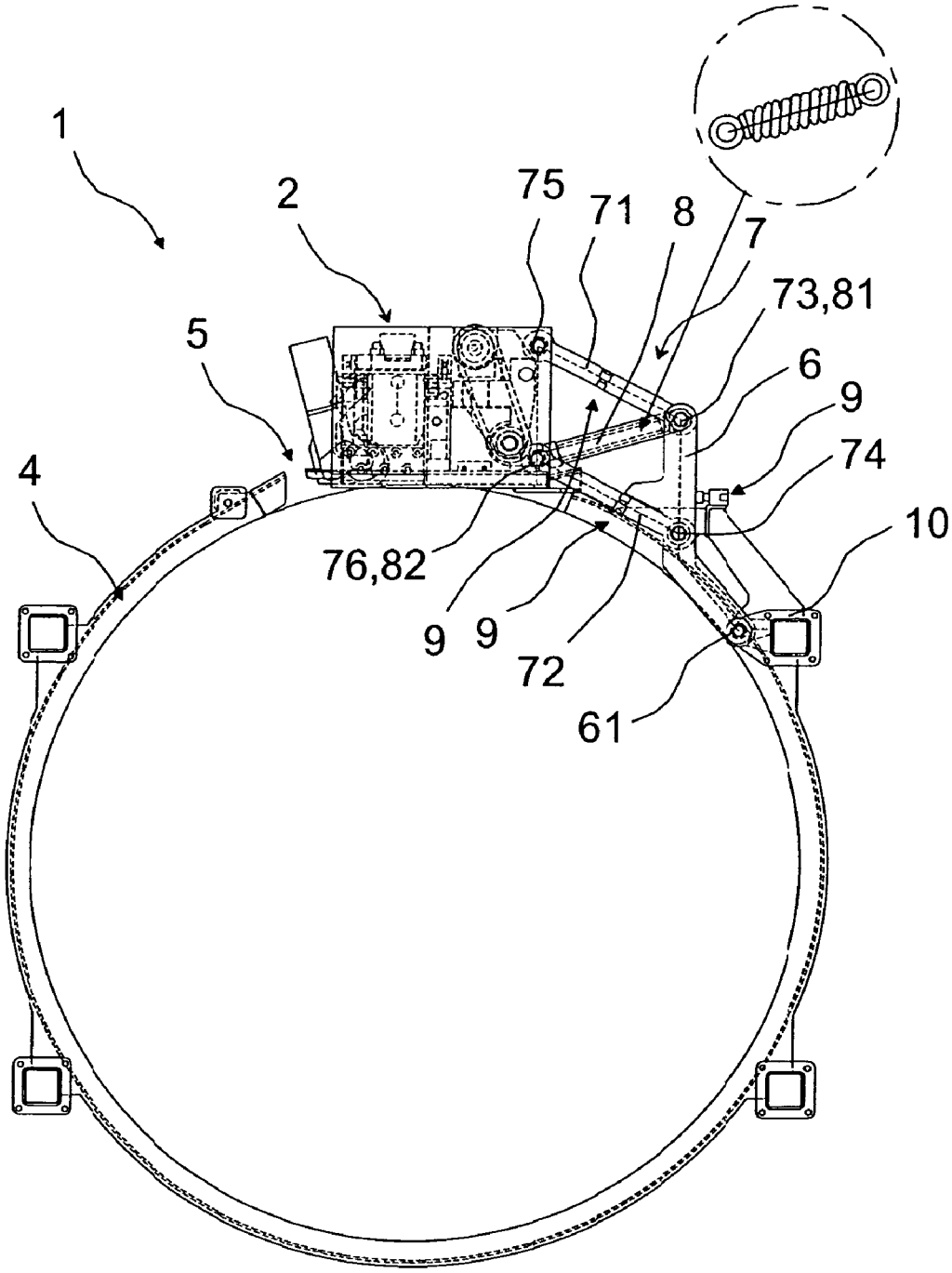
FIG. 1 shows an advantageous embodiment of the invention seen in the axial direction and with the binding means in their basic position.
Figure 2:
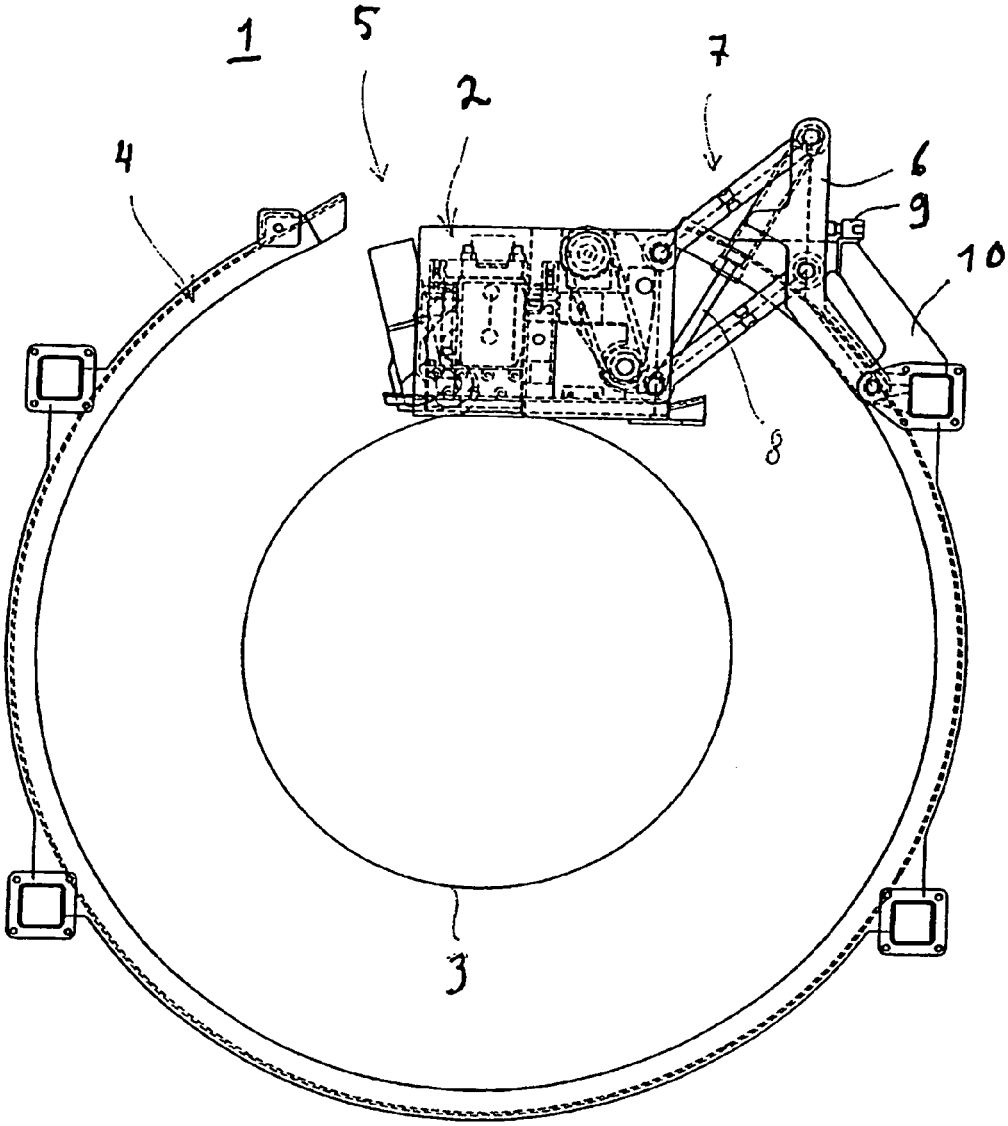
FIG. 2 shows the embodiment of FIG. 1 with the binding means and the band in a position corresponding to the pre-tightening of the band.
Figure 3:
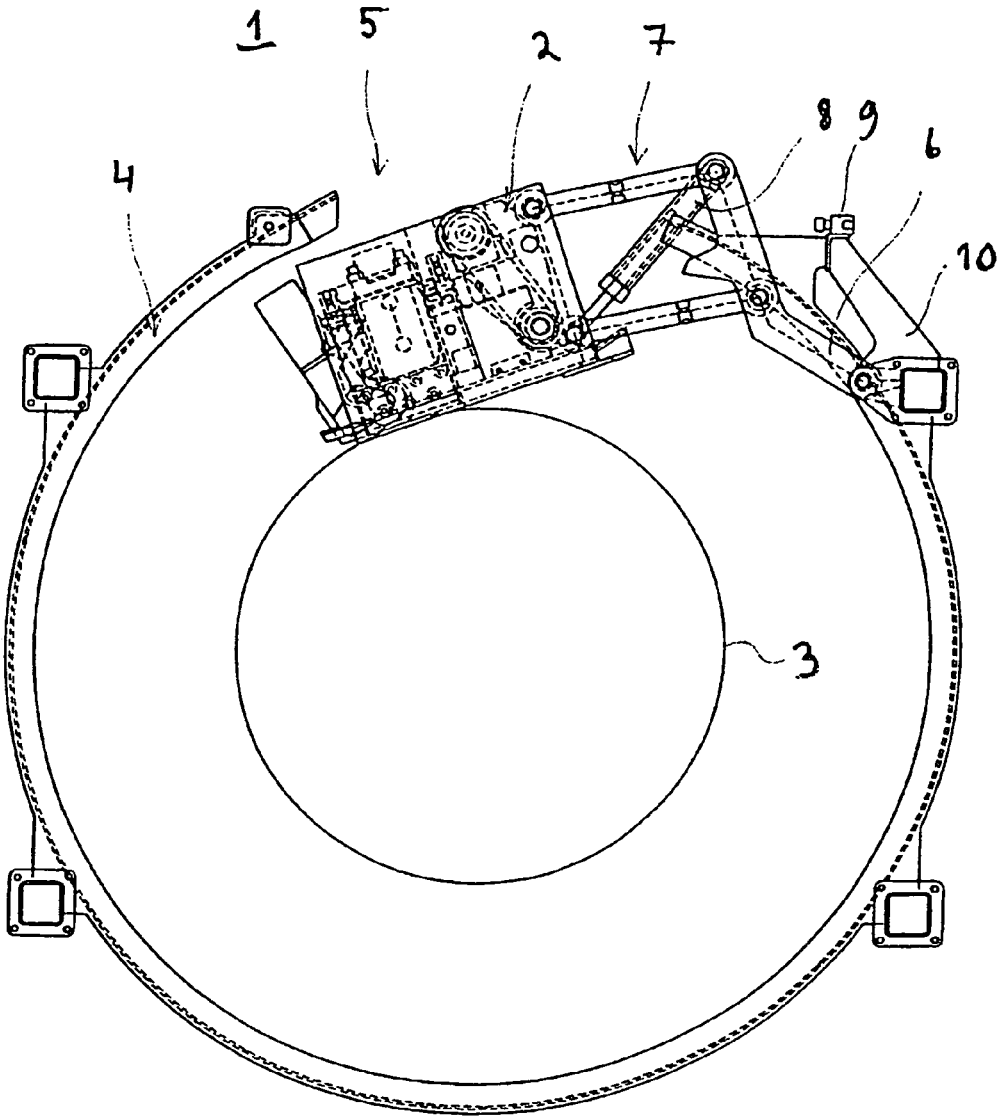
FIG. 3 shows the embodiment of FIG. 1 with the binding means and the band in a position corresponding to the final tightening of the band.
Figure 4:
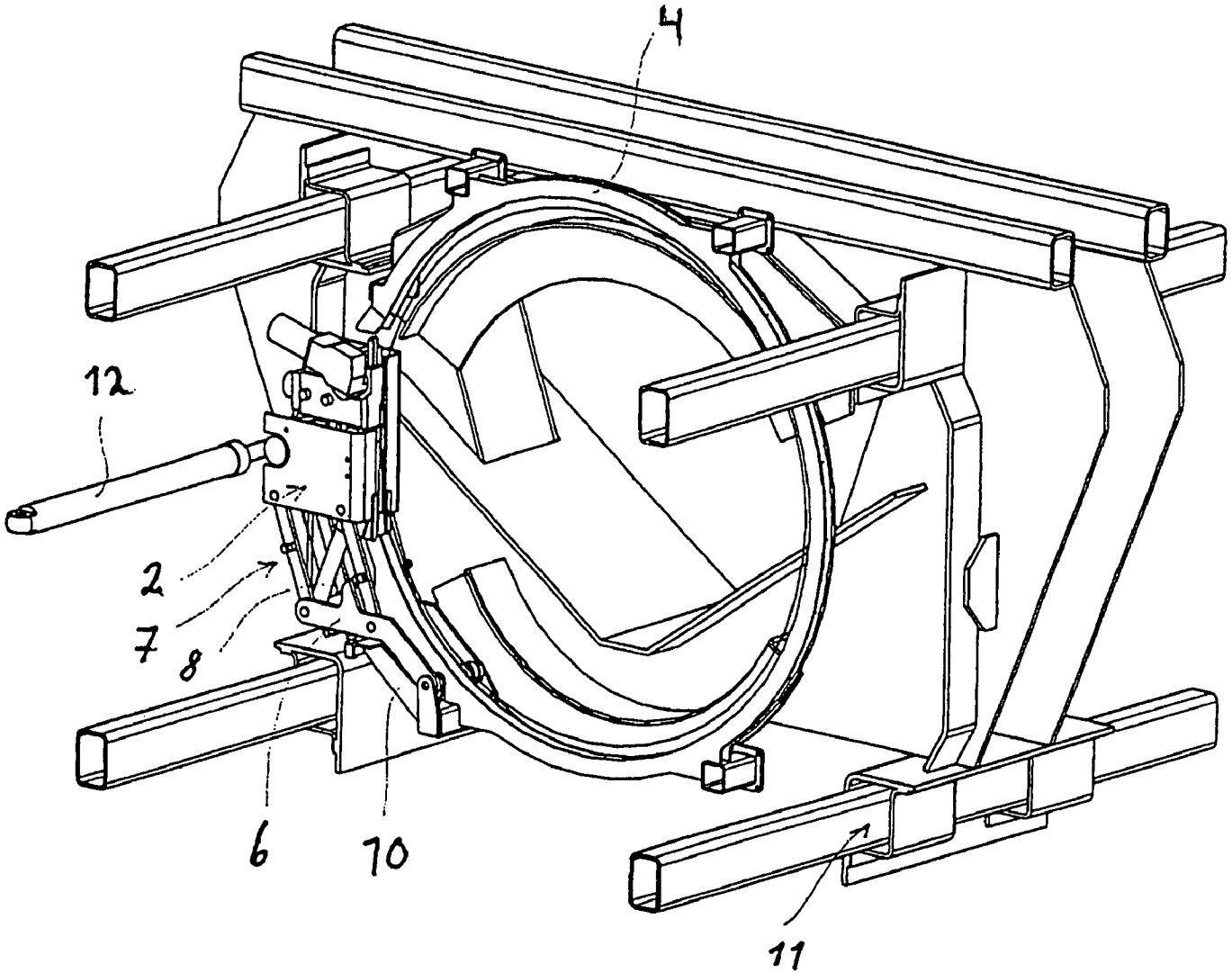
FIG. 4 shows the embodiment of FIG. 1 in a perspective view and placed in the frame structure of a compressing device, when the binding means are in their basic position.
Figure 5:
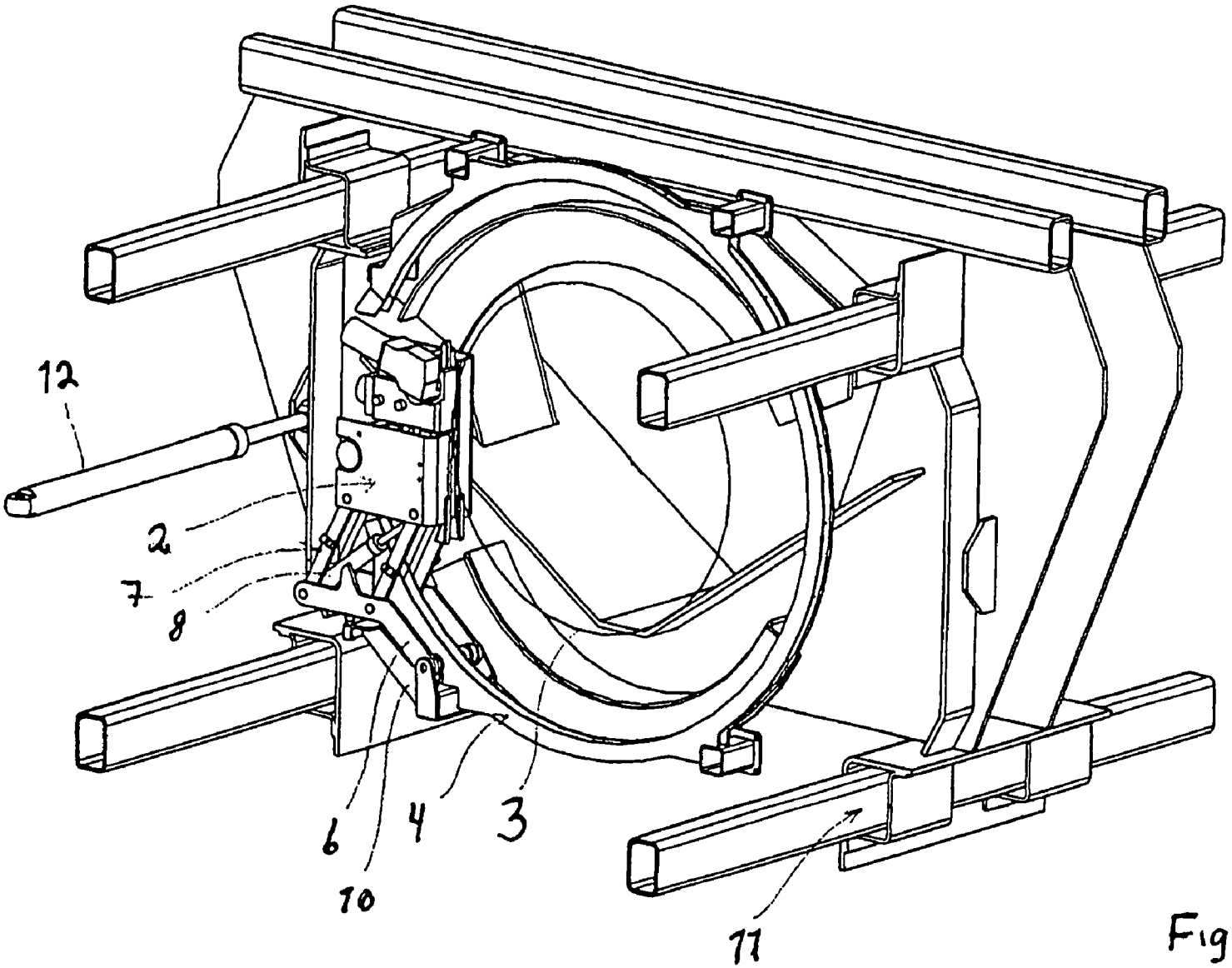
FIG. 5 shows the embodiment of FIG. 4 with the binding means and the band in a position corresponding to the pre-tensioning of the band.
Figure 6:
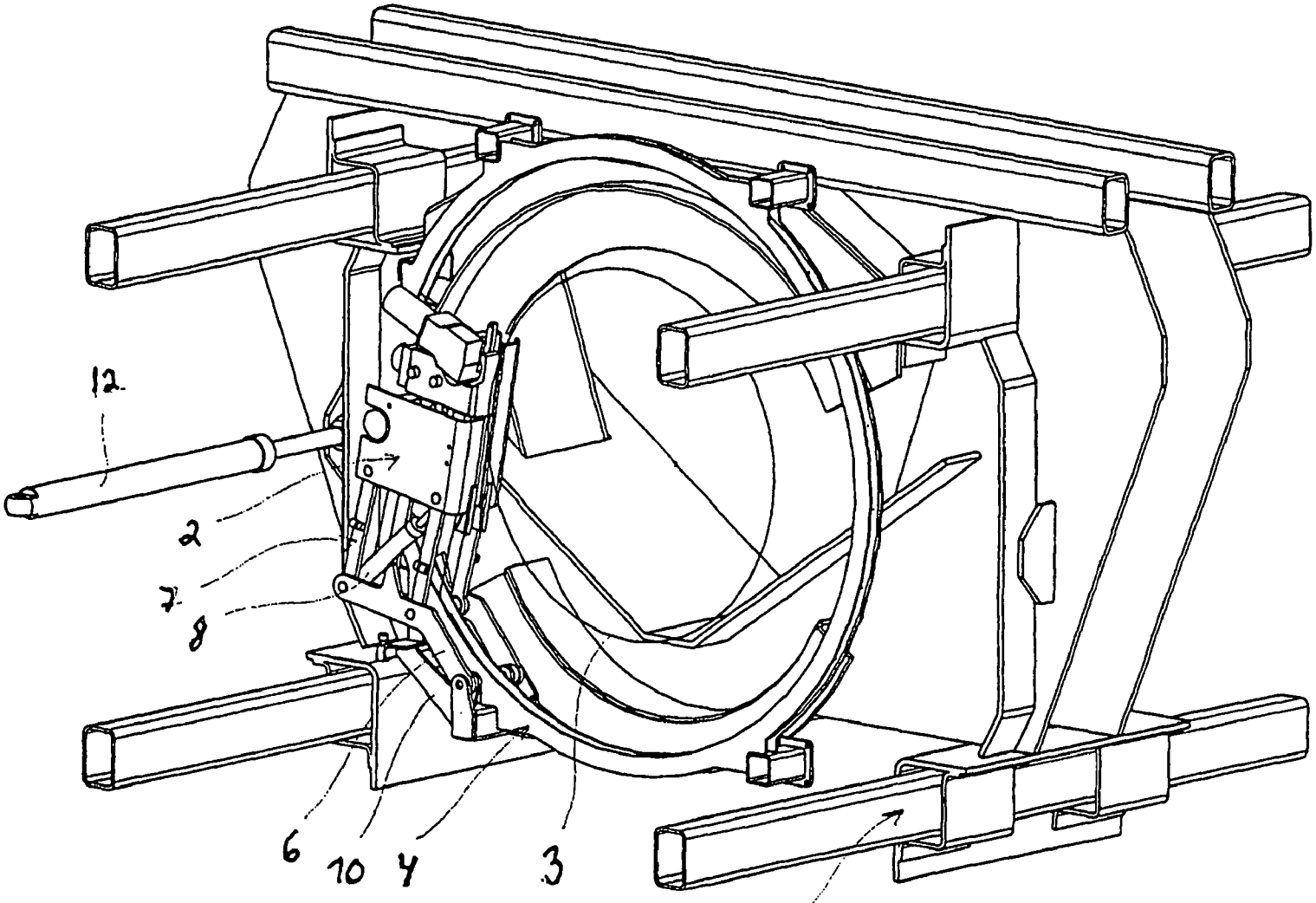
FIG. 6 shows the embodiment of FIG. 4 with the binding means and the band in a position corresponding to the final tensioning of the band.

FIGS. 1 to 6 show an automatic binding device 1 which is intended for binding a strap 3 around material which has been compressed and supplied in the axial direction. The device 1 may also form a part of an apparatus for compressing logging waste or small timber, whose structure and operation is known in other respects. In FIGS. 1 to 3, the structures which remain in the back are illustrated with broken lines. FIGS. 4 to 5 show perspective views of the situations corresponding to FIGS. 1 to 3. The strap 3 is preferably made of steel, but there are also known straps and bands made of other metal materials, as well as plastic materials, of which the strap 3 is formed by binding. The binding device 1 comprises binding means 2 which are intended for the automatic manipulation of the band 3. The more detailed structure and operating principle of these binding means 2 are known as such. They are intended for holding the forward end of the continuous band 3 and for feeding it around the material to be bound. The band 3 is normally fed from a coil (not shown in the figures) to the binding means 2. The end of the band 3 is formed, when the band 3 is cut after the strap 3 has been completed. This end of the band 3 is gripped by the means 2 to make automatic operation possible. The means 2 feed the band 3 to guide means 4 and also receive the end of the band 3 from the guide means 4. The end is held and fixed to the band 3 to form a strap which normally has the shape of a rim. The means 2 feed the band 3, and after receiving it, they also pull the band 3 backward, wherein the band 3 is tensioned around the material. The tensioning force will depend on the properties of the means 2.

The binding device 1 also comprises guide means 4, along which the forward end of the band 3 is guided and transferred in a controlled manner around the material to be bound. The band 3 is guided by the means 4 back to the binding means 2 for fixing. The binding means 2 are placed in an opening 5 placed between the initial and terminal ends of the guide means 4, where they receive the band 3 coming from the guide means 4. The binding means 2 push the band 3 to the guide means 4 and forward. The presented guide 4 is circular and uniform, except for the opening 5, but the shape may also vary, depending on the material to be bound. The guide means 4 are preferably placed in a plane which is substantially perpendicular to the axial direction. The axial direction corresponds to the direction of supplying the material and the longitudinal direction of the bundle of brushwood.

The binding device 1 also comprises a transfer mechanism for moving the binding means 2. The mechanism comprises at least one mounting arm 6 which is arranged by means of a joint 61 to revolve around a rotation axis, and at least one angular link mechanism 7 which comprises at least two swinging arms 71 and 72, which are coupled, on one hand, to the mounting arm 6 by means of joints 73 and 74, and on the other hand, to the binding means 2 by means of joints 75 and 76. The mechanism also comprises at least one actuator 8, preferably a cylinder, which is coupled between the binding means 2 and the mounting arm 6 by means of joints 81 and 82. The controllable actuator 8 is particularly used to return the means 2 to the initial position in a controlled manner. In the other direction, the actuator 8 is used, for example, as a decelerating brake. Instead of or in parallel with the actuator 8, there may be a decelerating actuator, such as a draw spring, which also returns the mechanism 7. The actuator 8 controls the position of the angular joint mechanism 7, and in the present embodiment, it is coupled in such a way that the joints 81, 82 have the same rotation axes as the joints 73 and 75. The swinging arms 71, 72 are preferably parallel and of equal length, wherein the orientation of the means 2 is maintained during their movement.

The mechanism 7 is arranged to allow the movement of the binding means 2 towards the material, wherein the mechanism 7 may also move together with the mounting arm 6. In the transfer, the binding means 2 move from the position of FIGS. 1 and 4 through the opening 5 into the guide means 4 and back in such a plane of movement which is substantially perpendicular to the axial direction. The achieved position is shown in FIGS. 2 and 5. Preferably, the above-mentioned plane of movement also corresponds to the plane in which the guide means 4 are placed in relation to the axial direction. By the effect of the swinging arms 71, 72 of the mechanism 7, the transfer movement is curved, but the orientation of the means 2 remains the same. The means 2 are preferably placed in such a way that they are placed in a floating manner substantially transversely to the axial central line of the material, which converges with the centre of the guide means 4 in FIG. 1. Particularly that part in the means 2 which holds the band 3 faces the central line. The forces between the band 3 and the means 2 automatically tend to turn the means 2 to the correct position in which the forces are balanced and the position is towards the material.

When the mounting arm 6 moves together with the angular link mechanism 7, the binding means 2 move in the direction of the surface of the material, or tangentially along the surface of the material, and back to the initial position. Consequently, they move from the position of FIGS. 2 and 5 to the position of FIGS. 3 and 6 as well as in a direction which is also the direction of feeding the band 3. The movement approaching the material is necessary when the band 3 is pre-tensioned and shortened by pulling it back to a length corresponding to the perimeter of the material to be bound. In the final tensioning, it is advantageous that the means 2 move in the direction of the surface so that the length of the band 3 would not increase but, on the contrary, would be shortened further. At the same time, the movement facilitates the tensioning, because the band 3 needs to glide less along the material. At this stage, the means 2 are inside the guide means 4 and partly also underneath them, wherein they have moved off the opening 5. The mechanism 7 and the arm 6 allow that the position of the binding means 2 in relation to the surface of the material remains substantially the same. When the material has a cylindrical shape and a circular cross section, the means 2 are as transverse to the central line as possible. Thus, the force effects caused by the tensioning and exerted on the band 3 or the means 2 remain as small as possible.

The dimensions and the more detailed geometrical definition of the mechanism 7 and the arm 6 will vary according to the shape of the material and the length of the transfer movement required by the means 2. The orientation of the means 2 may also vary to a slight extent, particularly during the pretensioning and the approaching movement. On the basis of the presented transfer movements, it will, however, be easy to fit the lengths of the means, the more accurate position of the joints in relation to the guide 4 or the means 2, and their points of mounting finally in the desired locations, wherein a more detailed description will not be necessary. In an advantageous embodiment, the rotation axes of the joints are substantially axial, and the planes of movement of the means 2, the mechanism 7 and the arm 6 are substantially perpendicular to the axial direction. At the same time, the swinging arms 71, 72 of the mechanism 7 and the mounting arm 6 are placed in planes of movement which are substantially perpendicular to the axial direction. In this way, a structure is achieved which is compact and as short as possible in the axial direction. The mounting arm 6 is preferably an elongated piece having a joint at its one end and being fixed to the mechanism 7 at its other end. Furthermore, so that the material passing through the joint 4 would have a clear passage, the rotation axes are placed outside the rim of the guide 4, when the means 2 are in their basic position. Also, it is advantageous that for example the mechanism 7 is placed as far away as possible from the material which is moving or which is to be bound.

It is possible to arrange the mechanism 7 and the mounting arm 6 as a sturdy structure which can be formed by means of simple joints, when the binding device 1 comprises two mounting arms 6 which are arranged to rotate around a common rotation axis, and two angular link mechanisms 7. The joints of the two different mechanisms 7, which correspond to each other functionally, share a common axis of rotation. A particularly compact structure is formed by placing the mechanisms 7 and the mounting arms 6 on different sides of the guide means 4. The arm 6 and the mechanism 7 on the same side are coupled to each other, wherein a fork-like structure is formed together with the means 2. Thus, the guide means 4 can be placed between the mechanisms 7 and the mounting arms 6 in different positions of the means 2, wherein the opening 5 does not need to be large. The means 2 are normally wider than the guide 4, but they are placed centrally in relation to them. The different mechanisms 7, or mounting arms 6, are made almost identical to simplify the manufacture.

During tensioning of the band, the means 2 are automatically pulled in the correct direction, wherein it will not be necessary to move the mechanism 7 actively with an actuator 8. The actuator or actuating means 8 will return the means 2 to their initial position. The movement of the mechanism can be synchronized by the actuator 8 precisely with the movement of the mounting arm 6 which is controlled by another actuator (not shown) which is preferably a returning draw spring or another arrangement coupled between the arm 6 and the frame 10. In place of or in parallel with said actuator, there may be a controlled cylinder, if the return movement is to be controlled more accurately. The synchronization is necessary to avoid impacts when the means 2 are inside the means 4 and particularly during the return motion after the band 3 has been cut and the strap 3 has been formed. The rigidity of the actuator or actuating means 8 is selected to be lower than the rigidity of the draw spring returning the arm 6, wherein the mechanism 7 moves first and the arm 6 after that, which is the correct sequence of movements for the tensioning.

The aim is that the means 2 float until the cutting of the band 3, after which they are returned in a controlled manner to the original position. It is also possible to install other springs in the mechanism 7 and in the arm 6. In connection with the mechanism 7 and the mounting arm 6, or fixed to the frame 10, there are normally also various lugs and stoppers 9 to restrict the transfer movements or the positions between the parts to the desired extreme positions. The operation is controlled by means of a control system for the binding device to control the control circuit of the actuators which comprises, for example, a pressure source and a valve system and which may be connected to various sensors installed, for example, in the joints of the mechanism 7 or the arm 6 to determine their position and to control the sequence of movements. Alternatively, the control system may also be the control system for the compressing device which takes care of the necessary working sequence for the whole apparatus and e.g. the binding. The binding device 1 can be connected to a large variety of compressing devices.

As shown in FIG. 4, the guide means 4 and the mounting arms 6 are connected to the frame structure 10. The frame structure 10, in turn, is connected by means of a guide arrangement 11 to the rest of the compressing device 13, of which only a part is shown in the figure. The guide arrangement 11 comprises axial beams on whose support the binding device 1 is centrally suspended and along which the device 1 moves. By means of the guide 11, the frame structure 10 is arranged to move back and forth substantially in the axial direction. For this purpose, the frame structure is also provided with the necessary means, such as an actuator 12, for example a cylinder which is driven by a pressurized medium and controlled by the control system according to the other operation of the compressing device, and which can be used to move the device 1 to a different location.

The device functions in such a way that the binding means 2 pull themselves from their basic position close to the material after the material has been compressed and the band 3 has been fed as a strap around the material. Pre-tensioning is effected in this way and the band 3 is not left loose. This movement is allowed by the mechanism 7 and the arm 6, which are free. After this, the band 3 is tensioned more by the binding means 2, and the binding means 2 are simultaneously allowed to move in the direction of the surface of the material. After the final tensioning, the binding means 2 lock the ends of the band 3, for example by punching, wherein a closed strap 3 is formed. At the same time, the band 3 is cut. Next, the means 2 move back to the basic position and feed a new band 3 to the guides 4 to start a new operating cycle.

The invention is not limited solely to the above-presented embodiment, but it can be modified within the scope of the appended claims.

The invention claimed is:

1. A binding device for binding logging waste or small timber material to a cylindrical bundle of brushwood, wherein the binding device comprises at least:

binding means arranged to feed a continuous band around the material to be bound, to compress the material by tensioning the continuous band, and to form a locked strap around the material by means of the continuous band, and a transfer mechanism arranged to allow the movement of the binding means from an initial position towards the material as the continuous band is tensioned, to allow the movement of the binding means in the direction of a surface of the material when the material is simultaneously compressed by tensioning the continuous band, and during the compression to allow the binding means to be continuously oriented towards the material at various points of the surface of the material, and further to return the binding means to the initial position after the formation of the locked strap, wherein the binding means and simultaneously the transfer mechanism are arranged to be movable away from the initial position towards the material and in the direction of the surface of the material by the effect of a force exerted by the binding means on the continuous band when the continuous band is tensioned.

2. The binding device according to claim 1, wherein the binding means and simultaneously the transfer mechanism are arranged to be returned in a controlled manner to the initial position by the effect of one or more actuators placed in the transfer mechanism.

3. The binding device according to claim 1, wherein the binding means and simultaneously the transfer mechanism are arranged to be returned to the initial position by the effect of one or more spring means placed in the transfer mechanism.

4. The binding device according to claim 1, wherein the binding means are arranged for automatic processing of the continuous band, for holding the forward end of the continuous band, for feeding the forward end of the continuous band around the material, for receiving the forward end of the continuous band, for attaching the forward end of the continuous band to the continuous band to form the locked strap, and for cutting the continuous band, wherein the binding device further comprises guide means placed substantially perpendicular to a longitudinal direction of the material and arranged for guiding the forward end of the continuous band around the material, and wherein the guide means comprise an opening in which the binding means are placed.

5. The binding device according to claim 1, wherein the transfer mechanism comprises:

a mounting arm arranged to rotate around a rotation axis by means of a joint, an angular link mechanism comprising at least two swinging arms coupled, on one hand, to the mounting arm by means of joints and, on the other hand, to the binding means by means of joints, wherein the angular link mechanism, in cooperation with the mounting arm, is arranged to allow the transfer of the binding means towards the material and back in a plane of movement which is substantially perpendicular to a longitudinal direction of the material, and wherein the mounting arm, in cooperation with the angular link mechanism, is arranged to allow the transfer of the binding means along the cylindrical surface of the material in a direction equal to the feeding direction of the continuous band, and back.

6. The binding device according to claim 5, wherein the transfer mechanism further comprises:

another mounting arm placed on a different side of a guide means in relation to the other mounting arm, wherein the mounting arms are arranged to rotate around a common axis, the guide means being arranged to guide the forward end of the continuous band around the material, and another angular link mechanism placed on a different side of the guide means in relation to the other angular link mechanism, wherein said another angular link mechanism comprises at least two swinging arms coupled, on one hand, to said another mounting arm by means of joints and, on the other hand, to the binding means by means of joints.

7. The binding device according to claim 5, wherein the transfer mechanism further comprises actuator means coupled between the binding means and the mounting arm, to control the position of the angular link mechanism.

8. The binding device according to claim 1, wherein the binding device further comprises:

a frame structure, to which a guide means and the transfer mechanism are connected, the guide means being arranged to guide the forward end of the continuous band around the material, a guide arrangement, to which the frame structure is connected and which is arranged for moving the frame structure back and forth in a longitudinal direction of the material, and actuator means which are coupled to the frame structure and arranged to move the frame structure.

9. The binding device according to claim 5, wherein said at least two swinging arms are substantially parallel and of substantially equal length, and rotated around parallel rotation axes.

10. The binding device according to claim 4, wherein the guide means comprise a circular chute.

11. A method for binding logging waste or small timber material by means of an automatic binding device, wherein the binding device comprises at least binding means arranged for feeding a continuous band around the material to be bound, for tensioning the continuous band and for forming a locked strap around the material, and a transfer mechanism arranged for moving the binding means, wherein the method comprises the steps of:

collecting the material in a continuous, cylindrical bundle of brush-wood and feeding it in a longitudinal direction, compressing the material for the bundle of brushwood further in the binding device by tensioning the continuous band fed around the bundle of brushwood, and finally, locking the continuous band into the locked strap which keeps the bundle of brushwood together, moving the binding means from an initial position towards the material as the continuous band is tensioned, moving the binding means in a direction of a cylindrical surface of the material when the material is simultaneously compressed by tensioning the continuous band further, moving the binding means and simultaneously the transfer mechanism away from the initial position towards the material and in the direction of the cylindrical surface of the material by the effect of a force exerted by the binding means on the continuous band when the continuous band is tensioned, during the compression, orienting the binding means continuously towards the material at various locations of the cylindrical surface of the material, and returning the binding means to the initial position after the formation of the locked strap.

12. The method according to claim 11, wherein the method further comprises the step of returning the binding means and simultaneously the transfer mechanism to the initial position under the control of at least one actuator or at least one spring means.

13. The method according to claim 12, wherein the method further comprises the step of returning the binding means and simultaneously the transfer mechanism to the initial position under the control of at least one actuator or at least one spring means.

14. The binding device according to claim 1, wherein the binding means and simultaneously the transfer mechanism are arranged to be returned in a controlled manner to the initial position by the effect of one or more actuators placed in the transfer mechanism.

15. The binding device according to claim 1, wherein the binding means and simultaneously the transfer mechanism are arranged to be returned to the initial position by the effect of one or more spring means placed in the transfer mechanism.

16. The binding device according to claim 5, wherein the binding means and simultaneously the transfer mechanism are arranged to be returned to the initial position by the effect of one or more spring means placed in the transfer mechanism.

17. The binding device according to claim 5, wherein:

the binding means are arranged for an automatic processing of the continuous band, for holding the forward end of the continuous band, for feeding the forward end of the continuous band around the material, for receiving the forward end of the continuous band, for attaching the forward end of the continuous band to the continuous band to form the locked strap, and for cutting the continuous band, wherein the binding device also comprises guide means placed substantially perpendicular to a longitudinal direction of the material and arranged for guiding the forward end of the continuous band around the material, and wherein the guide means comprise an opening in which the binding means are placed.

18. A binding device for binding logging waste or small timber material to a bundle of brushwood, wherein the binding device comprises at least:

binding means arranged to feed a continuous band around the material to be bound, to compress the material by tensioning the continuous band, and to form a locked strap around the material by means of the continuous band, and a transfer mechanism arranged to allow the movement of the binding means from an initial position towards the material as the continuous band is tensioned, to allow the movement of the binding means in the direction of a surface of the material when the material is simultaneously compressed by tensioning the continuous band, and during the compression to allow the binding means to be continuously oriented towards the material at various points of the surface of the material, and further to return the binding means to the initial position after the formation of the locked strap, wherein the transfer mechanism comprises:

a mounting arm arranged to rotate around a rotation axis by means of a joint, an angular link mechanism comprising at least two swinging arms coupled, on one hand, to the mounting arm by means of joints and, on the other hand, to the binding means by means of joints, wherein the angular link mechanism, in cooperation with the mounting arm, is arranged to allow the transfer of the binding means towards the material and back in a plane of movement which is substantially perpendicular to a longitudinal direction of the material, and wherein the mounting arm, in cooperation with the angular link mechanism, is arranged to allow the transfer of the binding means along the surface of the material in a direction equal to the feeding direction of the continuous band, and back.

19. The binding device according to claim 18, wherein the binding device further comprises:

a frame structure, to which a guide means and the transfer mechanism are connected, the guide means being arranged to guide the forward end of the continuous band around the material, a guide arrangement, to which the frame structure is connected and which is arranged for moving the frame structure back and forth in a longitudinal direction of the material, and actuator means which are coupled to the frame structure and arranged to move the frame structure.

* * * * *

UNITED STATES PATENT AND TRADEMARK OFFICE

CERTIFICATE OF CORRECTION

PATENT NO. : 7,073,432 B2
APPLICATION NO. : 10/489997
DATED : July 11, 2006
INVENTOR(S) : Mauri Marttila et al.

It is certified that error appears in the above-identified patent and that said Letters Patent is hereby corrected as shown below:

Claim 5, Col. 8, Line 16 the word "cylindrical" should be deleted.

Signed and Sealed this

Twenty-sixth Day of December, 2006

JON W. DUDAS
*Director of the United States Patent and Trademark Office*